United States Patent [19]

Buttner

[11] 4,225,764

[45] * Sep. 30, 1980

[54] STRAND ACTUATOR FOR PUSHBUTTON SWITCH

[76] Inventor: Horace J. Buttner, 1501 Palos Verdes Dr., North Harbor City, Calif. 90710

[ * ] Notice: The portion of the term of this patent subsequent to Nov. 20, 1996, has been disclaimed.

[21] Appl. No.: 928,032

[22] Filed: Jul. 25, 1978

Related U.S. Application Data

[63] Continuation-in-part of Ser. No. 873,030, Jan. 22, 1978, Pat. No. 4,175,222, which is a continuation of Ser. No. 720,319, Sep. 3, 1976, abandoned.

[51] Int. Cl.[2] ..... H01H 35/40

[52] U.S. Cl. ..... 200/159 R; 200/161

[58] Field of Search ..... 200/159 R, 16 A, 64, 200/153 J, 160, 280, 281, 331, 330, 161

[56] References Cited

U.S. PATENT DOCUMENTS

| | | | |
|---|---|---|---|
| 2,443,441 | 6/1948 | Birge | 200/161 |
| 3,223,813 | 12/1965 | Lewandowski | 200/159 R |
| 4,074,095 | 2/1978 | Romanowski | 200/331 X |

*Primary Examiner*—Willis Little

*Attorney, Agent, or Firm*—Pollock, Vande Sande & Priddy

[57] ABSTRACT

An actuator assembly for a small, versatile electrical switch of the type which includes a thimble telescoped over and axially slidable on a guide stud disposed between spaced conductor ends which are engaged by flanges of the thimble in a retracted position. The switch also includes a floating sleeve having radial latch dogs which are rotated during engagement with circumferentially spaced holding ribs in a surrounding housing to establish projected and retracted positions for the thimble. The actuator mechanism includes a strand of monofilament material extending through aligned apertures formed axially through the switch with a tie knot in an end of the strand adjacent an outer surface of a plunger acting to depress the thimble to engage or disengage an electrical connection within the switch in response to an operator pulling on a free end of the strand actuator.

15 Claims, 8 Drawing Figures

STRAND ACTUATOR FOR PUSHBUTTON SWITCH

CROSS-REFERENCE TO RELATED APPLICATIONS

The present application is a continuation-in-part of copending application Ser. No. 873,030 filed Jan. 22, 1978 by Horace Judson Buttner, now U.S. Pat. No. 4,175,222; which, in turn, is a continuation of application Ser. No. 720,319 filed Sept. 3, 1976 by Horace Judson Buttner and now abandoned. The subject matter of applications Ser. No. 873,030 and Ser. No. 720,319 is hereby incorporated by reference.

FIELD OF THE INVENTION

The present invention relates to a pushbutton switch assembly, and more particularly to actuator mechanisms for such switches.

BACKGROUND OF THE INVENTION

Pushbutton switch assemblies of the type discussed in copending application Ser. No. 873,030, now U.S. Pat. No. 4,175,222, permit an operator to push or depress an actuating plunger to engage or disengage an electrical connection within the switch. Heretofore pushbutton switches of the above referred to type have not been applied to applications in which the operator does not have access to the plunger to actuate the switching operation. For example, in a commercially successful closet light assembly both the light and its control switch are mounted within a support structure, wherein the switch assembly is not directly accessible to the operator. As a result, a non-pushbutton switch and pull cord actuator is now used which is both cumbersome and relatively complex.

SUMMARY OF THE INVENTION

As will be discussed in detail hereafter, applicant's new and useful invention is a pushbutton switch assembly having a simple actuating mechanism which is adaptable for use in inaccessible locations.

A preferred embodiment of the present invention comprises an actuator for a pushbutton switch capable of electrically connecting a pair of conductors each having ends retained in the switch. The switch has a housing including a barrel having an axis and a head portion generally transverse to the axis. A cover is secured to the head with the conductor ends secured in non-conducting relation between cover and head. A contact is moveable along the axis for bridging the conductor ends. A sleeve mounts the contact for axial movement and a plunger, mounted in the barrel, engages the sleeve for projecting the sleeve and contact against the action of a coil spring biasing the contact, sleeve and plunger to a retracted position in which the contact bridges the conductor ends. A ratchet mechanism, for rotary indexing fo the sleeve, serves to latch the contact and sleeve, on alternate successive operations of the plunger in said retracted position and in a projected position wherein the contact is out of engagement with the conductor ends.

The switch actuator mechanism comprises an elongated strand of material, such a fish line or the like, which passes completely through a plurality of axially aligned apertures extending through the switch assembly. Suitable securing means, which may be a simple tie knot adjacent an outer surface of the plunger prevents the strand from being accidently drawn through the switch assembly. To engage or disengage an electrical connection within the switch, an operator grasps and pulls on a free end of the strand actuator to depress the plunger and either engage or disengage the electrical connection.

The strand actuator obviates the need for direct contact between the operator and the switch plunger, which allows the pushbutton switch to be mounted within a housing with only the strand actuator being accessible to the operator.

BRIEF DESCRIPTION OF THE DRAWINGS

A preferred embodiment of the present invention will now be described in more detail in the following portions of this specification when taken in conjunction with the attached drawings in which like reference characters identify identical apparatus and in which.

DETAILED DESCRIPTION OF THE PREFERRED EMBODIMENTS

Figure 1:
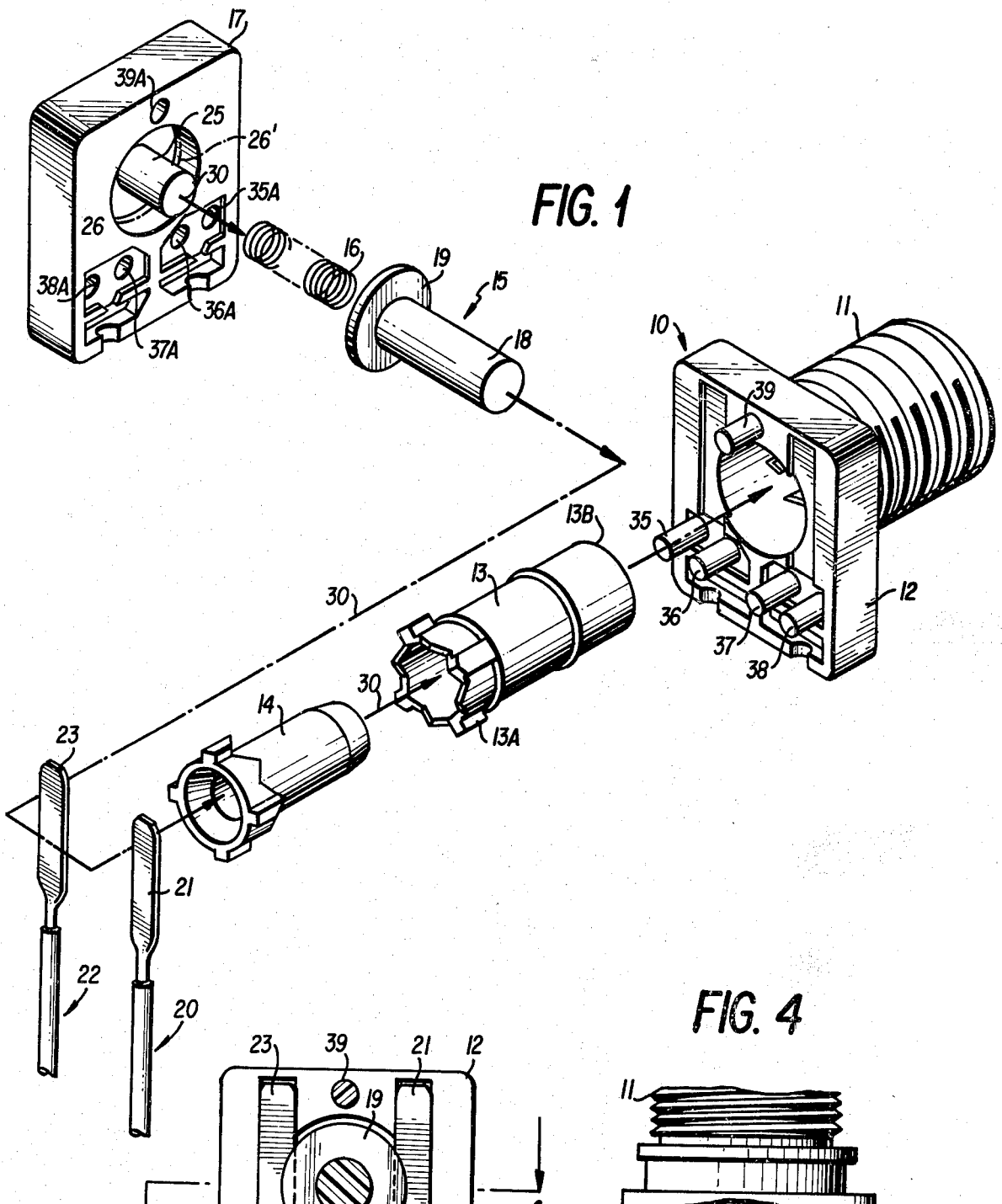
FIG. 1 is an exploded view of the inventive switch.

FIG. 1 is an exploded view of the several components of a switch embodying the present invention. More particularly, the switch comprises a housing 10 including an externally threaded barrel 11 having an axis 30 and a head portion 12 which is generally transverse to the axis 30. The head portion includes a plurality of pins 35–39, whose purpose will be discussed hereinafter. A generally cylindrical plunger 13 is arranged for sliding movement within the barrel 11 along the axis 30 with one end 13B available for projection along the axis 30. Fitted within the plunger 13 is a generally cylindrical sleeve 14 also aligned on axis 30 and arranged, by apparatus to be described, for motion longitudinal of the axis 30 and further arranged for rotational movement about the axis 30. A contact 15 is arranged to fit within the cylindrical sleeve 14 for motion along the axis 30. The contact 15 comprises a thimble-like contact having a generally cylindrical portion 18 and an annular flange 19 at one end thereof. A coil spring 16 is arranged to fit within the cylindrical portion 18 of the contact 15 and to bear against the contact 15 and a guide stud 25. The guide stud 25 comprises a portion of a cover 17 and serves to partially define an annular recess 26 in the cover 17. Additional recesses 35A–39A are included in the cover 17 for mating with the pins 35–39 of the head 12. The interference fit between the pins 35–39 and the recesses 35A–39A secure the cover 17 to the head 12 when the switch is assembled as well as locating the cover 17 properly with respect to the head 12.

The function of the switch is to selectively make or break an electrical connection between a pair of conductors, such as conductors 20 and 22. To this end, each of the conductors 20 and 22 may be provided with a terminal 21 and 23, respectively. The terminal, whether in the form of coined end on the conductor (FIG. 1) or a crimped on terminal (FIG. 2) is positioned so its shoulders are held by a pair of the pins such as 35–36 or 37–38 to properly locate the conductors 20 and 22 within the switch 10 (see in this regard FIG. 3). To make the electrical connection the flange 19 of the contact 15 bridges the coined ends 21, 23. Of course, at least the flange 19 (and preferably the entire contact 15) is formed of a conducting material.

Figure 3:
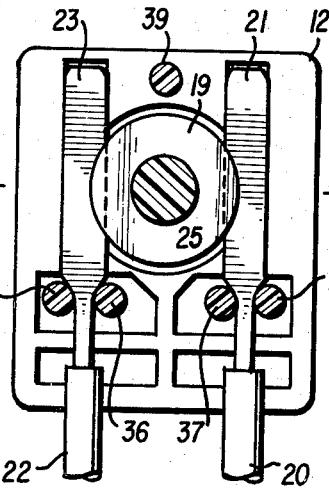
FIG. 3 is a cross-section taken on the lines 3—3.
Figure 4:
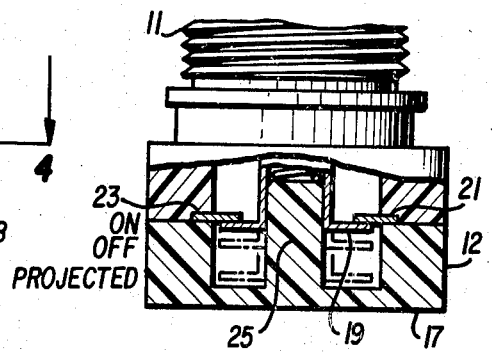
FIG. 4 is a section of the switch taken on the lines 4—4.
Figure 2:
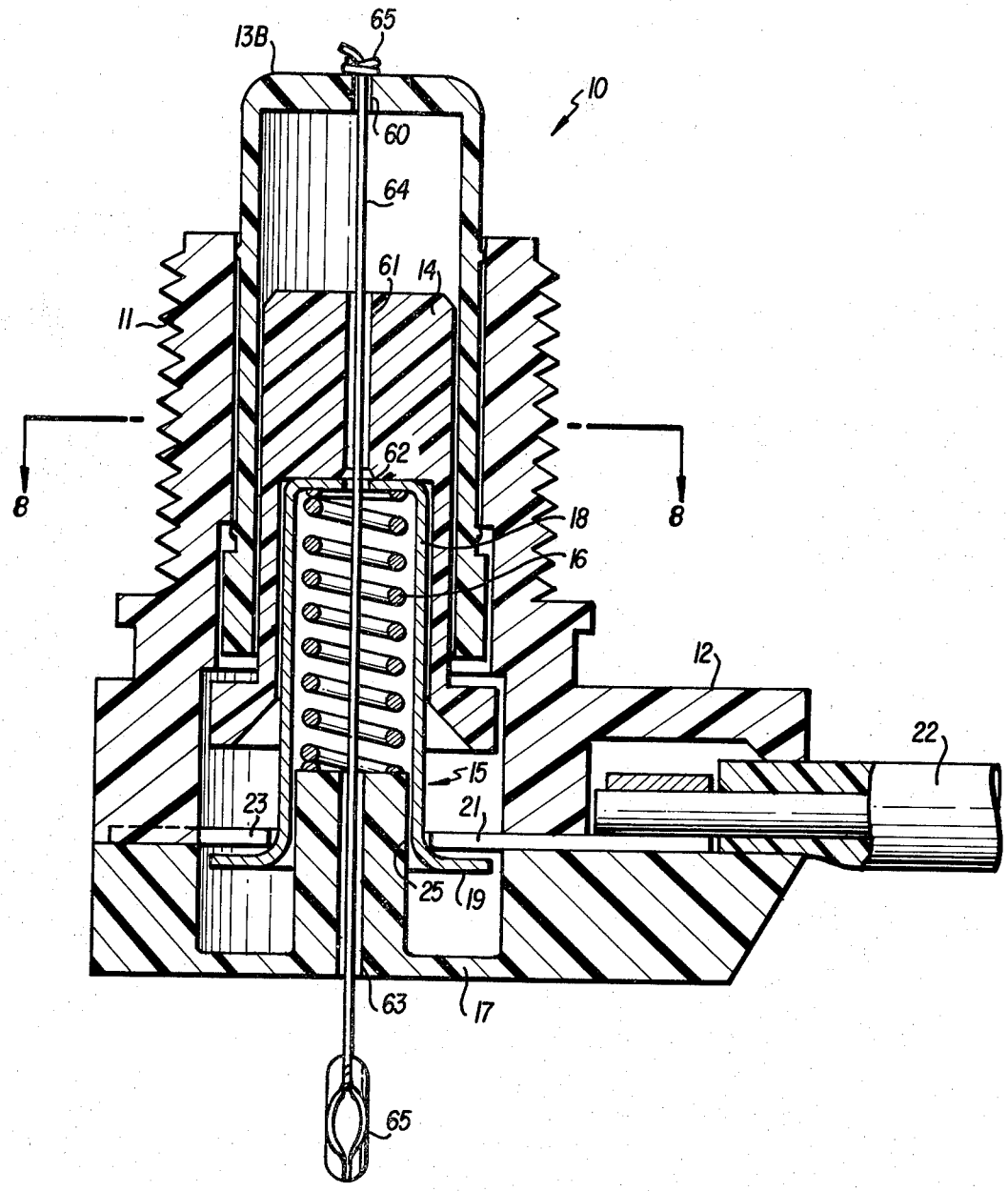
FIG. 2 is a cross-section of the switch and actuator mechanism taken through an axis thereof.

FIG. 2 is a cross-section of the switch in the closed condition, and FIG. 3 is a section taken on section lines 3—3 of FIG. 4. FIG. 4 illustrates still a different section of the switch taken on the lines 4—4 of FIG. 3. FIG. 4 illustrates the switch in the closed condition, wherein the flange 19 of the contact 15 bridges the coined ends 21 and 23 of the conductors 20 and 22 to establish an electrical connection. The legend "ON" indicates that when the flanged end 19 is in the closed condition shown, the switch is "ON". The adjacent dotted showing of flange 19, corresponding to the "OFF" legend, indicates that this is a second position of contact 15 wherein the switch is in the "OFF" condition. Finally, a second dotted showing of flange 19, associated with the legend "PROJECTED" indicates that as the plunger 13 is depressed, the flange 19 reaches the position shown. Actually, the contact 15 has two stable positions, the "ON" and "OFF" positions. The first of these positions is achieved through the action of the coil spring 16 biasing contact 15 against the stud 25. This biasing force establishes a solid electrical connection between the flange 19 and the coined ends of conductors 21 and 23. The second stable condition of the switch is achieved through the operation of a ratchet mechanism to be described hereinafter.

As shown in FIG. 1, plunger 13 carries a plurality of lugs 13A (as shown in FIG. 1, four lugs are provided). Corresponding extended recesses or ways are provided in the interior of the barrel 11 to allow the plunger 13 to move parallel to the axis 30, but the lugs prevent rotation of the plunger 13. Furthermore, the projecting end of the plunger 13 includes a plurality of spear pointed camming teeth. The sleeve 14, when telescoped into the bore of the plunger 13, has a plurality of rearwardly projecting camming teeth which cooperate with the forwardly projecting camming teeth on the plunger 13. In addition to the camming teeth of sleeve of sleeve 14, the sleeve 14 also carries a plurality of latch dogs projecting radially from alternate ones of the camming teeth, each of the dogs have a rear end of sawtooth form defining a camming ramp extending diagonally the full width of the dog. As shown in FIG. 1, a sleeve 14 carries four latch dogs which engage alternately the four extended recesses or ways in barrel 11 and four partial recesses or ways which limit axial motion of sleeve 14 in an intermediate or off position and function as latching pockets.

In the retracted position of the sleeve 14, the latch dogs are received in ways defined in the inner circumference of the barrel 11, these ways also serve to guide lugs 13A. At the forward or projecting end of the ways, diagonal shoulders define camming ramps. The outer diameter of the latch dogs on the sleeve 14 is greater than the inner diameter of shoulders in the camming ramps defined in the inner surface of the barrel 11. As a result, when the dogs of sleeve 14 are urged rearwardly by the coil spring 16, they engage shoulders and the camming action effects rotary indexing of the sleeve 14 to move the dogs into the latching pockets to establish a latched position of the switch. The dimensions of the ways and camming ramps associated with the outer surface of sleeve 14 establish the "OFF" position of the switch, in which the flange 19 achieves the "OFF" position illustrated in FIG. 4. A more complete description of the inter-action of the lugs, latch dogs and various camming surfaces of the plunger 13, sleeve 14 and barrel 11 is found in U.S. Pat. No. 3,694,603. While that patent accurately describes the operation of the aforementioned components which form a ratchet mechanism, which in certain rotary positions of sleeve 14 allow the flange 19 to be held in the "OFF" condition against the action of the spring 16, the remaining components of the switch, described here, have significant differences. Specifically, when the contact 15 is held by the ratchet mechanism in the projected position against action of the spring 16, the switch is open, in contrast to the teachings of U.S. Pat. No. 3,694,603 in which position the switch is closed. The washer 26' (shown dotted in FIG. 1) is not used for the push-push embodiment of FIGS. 1–4 but may be used in the momentary off embodiment later described.

Figure 7:
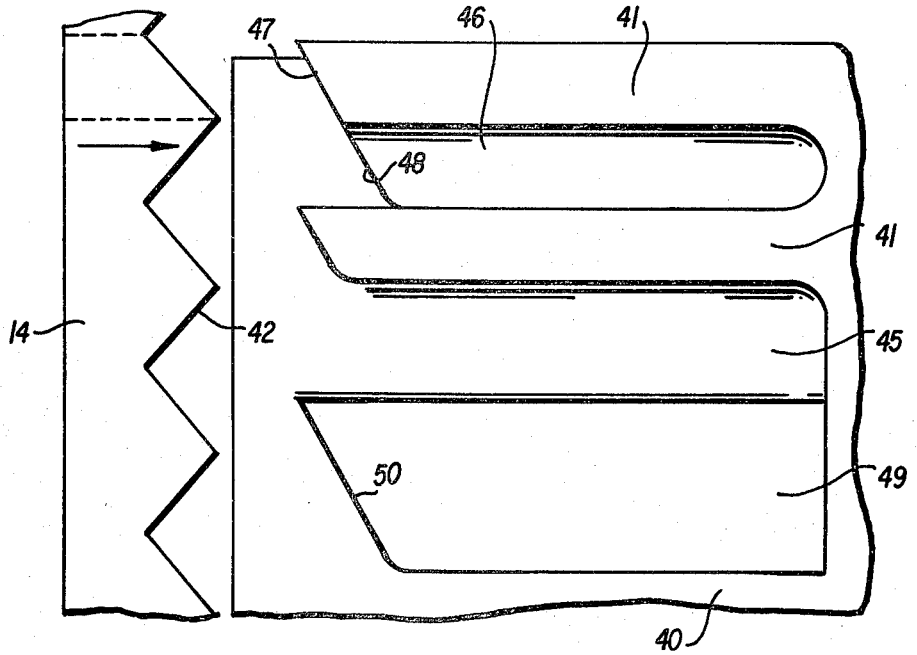
FIG. 7 is a developed view of the interior chamber of the barrel end ratchet assembly.
Figure 8:
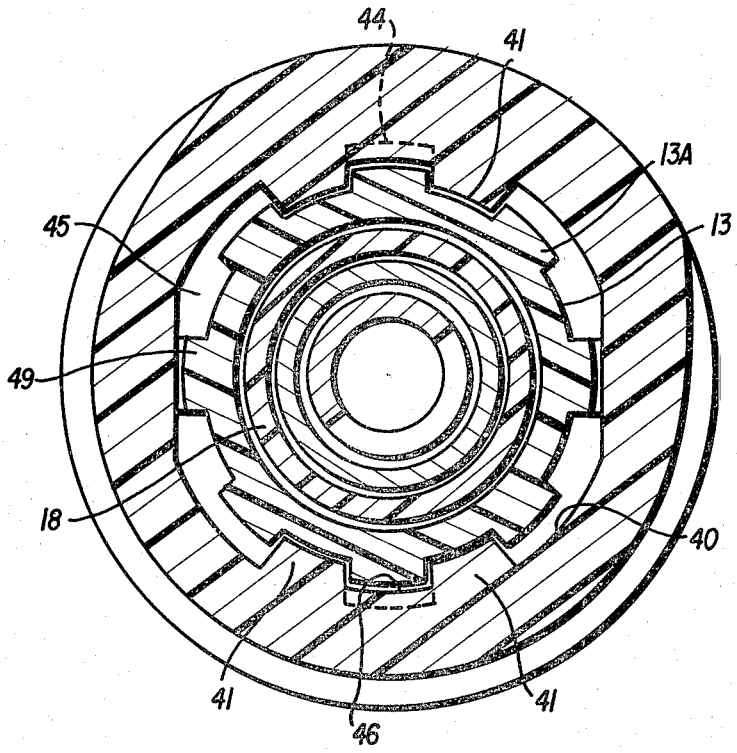
FIG. 8 is a cross-section view taken on the lines 8—8 of FIG. 2.

More particularly, the ratchet mechanism includes plunger 13, sleeve 14, as well as a recess or ways in the inner surface of the barrel 11. FIG. 7 is a developed view of the interior chamber 40 of barrel and ratchet 11, and FIG. 8 is a cross-section of the barrel taken at line 8—8 of FIG. 2. The interior chamber 40 is internally splined as shown in FIGS. 7 and 8; however, a ratchet with four rather than eight splines is preferred from the standpoint of wear resistance. The plunger 13 has lugs **13*a* which are slidably received between diametrically opposed pairs of circumferentially spaced ribs 41. Thus, plunger 13** is freely reciprocable but fixed against rotation.

Sleeve 14 is telescoped into plunger 13 with its rearwardly projecting camming teeth 42 in axially opposed relation to the camming teeth 43 of the plunger 13. The cooperation of the camming teeth 42 and 43 produce rotary indexing of sleeve 14 when it is released for such rotation by being projected. Latch dogs 44 are received in ways 45 defined alongside the ribs 41. The spaces between ribs 41 are alternately deeper (that is, of greater radius from the axis 30) and shallower, the deeper spaces being identified as ways 45, and the shallower spaces being made shallow by webs 46 between the splines. At the forward end, the ribs 41 and webs 46 have diagonal shoulders 47 defining camming ramps extending from one rib 41 to the adjacent rib of the pair to define a camming pocket 48. The outer diameters of the latch dogs 44 are greater than the inner diameter of the shoulders 47. When contact 15 and ratchett 11 are urged rearwardly by the spring 16, dogs 44 will engage shoulders 47 with a camming action to effect rotary indexing of the sleeve 14 to move dogs 44 into pockets 48 to establish a latched position of the switch. In between pairs of ribs 41 are flat lands 49 with diagonal forward ends defining camming ramps 50 which may assist indexing to latched positions by engagement with dogs 44 alternate to those in latching position.

In a preferred embodiment of the invention each of the switch components comprising the barrel and head 11 and 12, plunger 13, sleeve 14, a cover 17 can be inexpensively molded, preferably employing plastic material. Although this is preferred from the standpoint of cost and ease of construction, those skilled in the art will understand that other materials, and other fabrication methods, could be employed as well. It is essential, of course, that if any portions of the head 12 or cover 17 are formed of a conducting material, insulation must be provided to prevent electrical connection between the coined ends 21 and 23. As shown in the drawings, the barrel 11 has an external thread which facilitates mechanical mounting of the switch in a manner which is adequately set forth in the referred-to-patent.

Referring again to FIG. 2, the strand actuator mechanism will now be described in detail. Axially aligned apertures 60–63 extend completely through end 13B of plunger 13, an end of sleeve 14, an end of contact 15 and guide stud 25, respectively. A strand of fish line type material 64 passes through aligned apertures 60–63 and includes a tie knot 65 formed at an end adjacent to an outer surface of plunger end 13B. An opposite end of strand 64 may include an attached member 66 which is easily grasped by an operator. In an alternative embodiment, conventional pull chain assembly, not shown, may extend from member 66 or member 66 may be eliminated altogether, allowing the operator to directly grasp strand 64. Thus "strand" refers herein to any elongated member of adequate tensile strength whether of one or more strands and whether or not the so-called strands are continuous, as in monofilament, or are joined discontinuous elements, as in a pull chain or woven fiber cord.

In operation, when the switch is mechanically mounted in the desired position and the conductors 20 and 22 are attached to an electrical device which is controlled by the switch, the following operation can be achieved. To begin this description we will assume that the sleeve 14 is rotated to a position which will allow sleeve 14, plunger 13 and contact 15 to be urged to the retracted position under the force exerted by the spring 16. In this condition, electrical connection is made between the coined ends 21 and 23. To operate the switch, member 66 attached to strand actuator 64 is pulled. This draws tie knot 65 against plunger 13, with further pulling of member 66 causing plunger 13 to compress spring 16 and projecting sleeve 14. This operation, at the same time, projects the contact 15 so that the previously closed circuit is now opened. As the manually exerted force is now removed, the plunger 13, sleeve 14 and contact 15 are again urged to the retracted position by the spring 16. However, as the sleeve 14 travels to the retracted position, the camming action of the ratchet mechanism rotates the sleeve 14 so that the latchdogs become trapped in the latching pockets against the action of the spring 16. This maintains the flange 19 in the position of FIG. 4 associated with the "OFF" legend. This corresponds to the switch being open. Subsequent pulling of strand actuator 64 and plunger 13 results in similar operation, although rotary indexing of the sleeve 14 results in the latchdogs being removed from the latch pockets and thus allows the contact 15 to be retracted under the force exerted by the spring 16 to the solid condition shown in FIG. 4, at which time the flange 19 bridges the coined ends 21 and 23. Thus, successive manual operations of the plunger 13 enable the switch to change from the closed to the open condition. In the switch field this is termed a push-push function.

In another embodiment of the invention, the switch function is of the "momentary off" type. In this embodiment, the contact 15 has only a single stable position, the "ON" condition. Projection of the plunger by pulling strand 64 via member 66 results in projection of the flange 19 to remove the bridging of coined ends 21 and 23, but only for so long as the plunger 13 remains projected. As soon as the projecting force of of tie knot 65 is removed from the plunger 13, the flange 19 returns to the solid line illustration in FIG. 4, again bridging the conductors 21 and 23. For this type of operation, rotary indexing of the sleeve 14 is to be prevented, to thus prevent the latch dogs from being trapped in the latch pockets restraining the sleeve against the action of the spring 16. This can be simply effected by, for instance limiting projected travel of contact 15 in cavity 26 of cover 17, by a washer or similar device. A suitable washer 26′ is shown dotted in FIG. 1. Alternatively, the sleeve 14 can be omitted and and plunger 13 increased in length with omission of camming teeth. Other modifications that can be employed to prevent a ratcheting operation will occur to those skilled in the art. Regardless of the manner in which it is effected, when rotary indexing of sleeve 14 is prevented, the switch will have only the single stable "ON" condition in which the flange 19 bridges the conductors 21 and 23. This condition will be maintained in the absence of a force exerted on strand 64 for projecting the plunger 13. The switch will be in the "OFF" or open condition only for so long, as the force remains to maintain the plunger 13 in a projected condntion.

Figure 5:
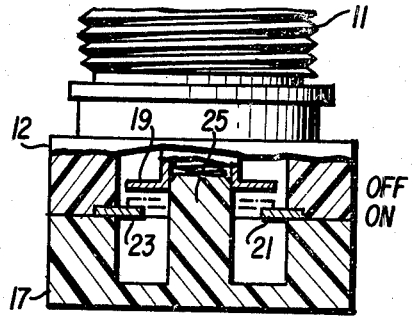
FIG. 5 is a section similar to FIG. 4 showing, however, a modified version of the switch.

Still another variation of the switch enables the switch to perform the "momentary on" function. To effect this, the switch is modified such that the flange 19 does not contact the coined ends 21 and 23 as shown in FIG. 4, but rather can only contact them as shown in FIG. 5. In this configuration, flange 19 has an "OFF" position in which the contact 15 is held off the coined ends 21 and 23 through the force exerted by the coil spring 16. Depression of the plunger can, however, displace the flange 19 to the dotted line position shown in FIG. 5 (the "ON" position) in which case it bridges the coined ends 21 and 23 to establish an electrical connection. Thus, the switch will only be "ON" so long as the plunger 13 is projected by some external force. For this configuration of the switch, of course, the assembly must be varied slightly inasmuch as the flange 19 of the contact 15 is on the opposite side of the coined ends 21 and 23 as compared with the assembly required to produce the switch configuration shown in FIG. 4. Furthermore, in order to prevent rotary indexing which is, of course, unnecessary, the sleeve 14 may be eliminated and plunger 13 modified as before mentioned.

It will thus be seen that with slight modifications, the switch of the invention can alternatively perform a push-push, momentary off, or momentary on function when actuated by a pulling strand 64, which greatly increases the versatility of the switch and enlarges its field of application. Furthermore, this disclosure is believed to demonstrate to those skilled in the art the advantages to be gained by the switch in the push-push and momentary off configurations in which positive electrical contact is made between the flange 19 and the coined ends 21 and 23 by reason of the bias exerted by the coil spring 16.

Figure 6:
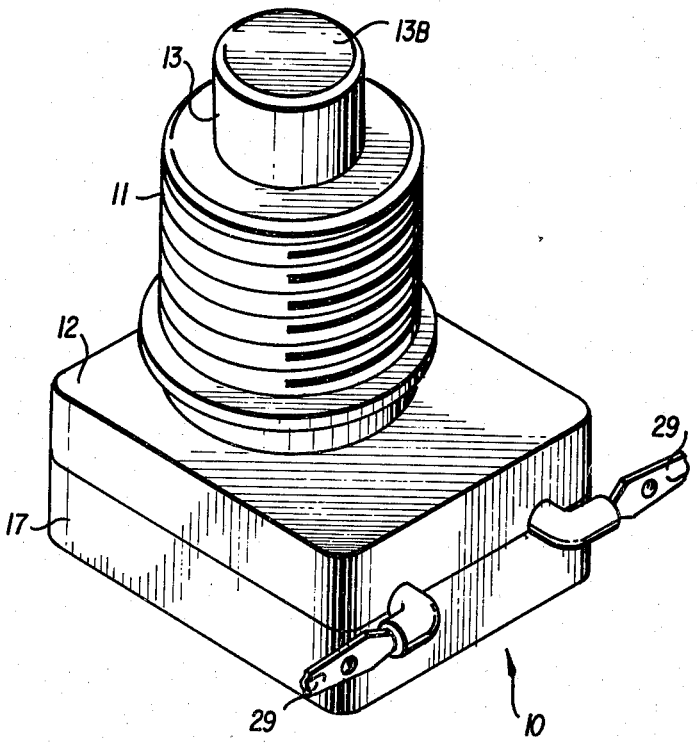
FIG. 6 illustrates the switch with connectors on the conductors, external to the switch housing.

FIG. 6 is an isometric view of an assembled switch of the invention illustrating that the conductors 20 and 22, external of the switch, have spade connectors 29 mounted thereon. Many other types of electrical connectors could be employed, whether external to the switch or not, within the spirit and scope of the invention.

It should also be understood that the securing means for the strand actuator may take a wide variety of forms. While the tie-knot securing means of the herein-described preferred embodiment is part of the strand, the securing means may be formed as part of the strand and/or as part of the plunger, or may be an element separate from both the strand and plunger which is adapted to secure them together or at least to prevent them from becoming separated during actuation. Thus, the knot may be replaced with a jam-cleat arrangement in the plunger, or a member of substantial size compared to the strand diameter may be crimped onto the strand. If the strand is secured within the plunger, or is secured to the moveable contact, e.g. thimble, instead of the plunger, it may not be necessary to provide an aperture in the plunger.

Based on this disclosure and the prior art, persons skilled in the art will readily make many useful modifications of the preferred embodiments described above. Therefore, the scope of the invention is to be defined by the claims appended hereto and should not be limited to the said preferred embodiments.

I claim:

1. A pushbutton switch and actuator mechanism or electrically connecting a pair of conductors, each conductor having an end retained in said switch, and comprising:

a housing including a barrel with an axis and head portion generally transverse to said axis, a cover secured to said head with said conductor ends secured, in electrically non-contacting relation, between said head and cover, said head and cover including insulating means to prevent an electrical connection between said conductors through either said head or said cover, a contact moveable along said axis for bridging said conductor ends for electrically connecting said conductors, means mounting said contact for said axial movement to make or break said electrical connection, a plunger axially slidable in said barrel and engaging said mounting means for projecting said mounting means in an axial direction, aligned apertures axially extending through said moveable contact and said housing, respectively, biasing means yieldably biasing said contact, mounting means and plunger for return to a retracted position in which position said contact bridges said conductors, a ratchet mechanism on said housing and mounting means for retaining said mounting means in a projected position against the bias of said biasing means, actuator means positioned within said axially aligned apertures for selectively stroking said plunger axially within said barrel, said plunger transmitting axial motion to said mounting means on a first stroke for operating said ratchet mechanism to retain said mounting means in a projected position at the conclusion of said stroke in which position said contact is out of engagement with said conductor ends, said plunger transmitting axial motion to said mounting means on a second stroke for operating said ratchet mechanism to allow said biasing means to return said contact and mounting means to a retracted position, in which position said contact is in engagement with said conductor ends.

2. The switch of claim 1 comprising a momentary off switch which further includes:

means for preventing operation of said ratchet mechanism whereby said contact normally bridges said conductors and axial motion of said plunger opens said electrical connection only for so long as said plunger is projected.

3. The switch of claim 2 in which:

said moveable contact comprises a thimble-like contact having a cylindrical portion and at one end thereof an annular flange for contacting the coined ends of said conductors, said cover includes a guide stud aligned with said axis, said yieldable biasing means includes a coil spring mounted in said cylindrical portion and bearing against said guide stud, and said means preventing operation of said ratchet mechanism includes a washer mounted in said cover about said guide stud.

4. The switch of claim 1 in which each of said conductors includes, at an end external to said switch, a connector for making connection to an electrical conductor.

5. The switch of claim 4 in which said connector is a spade connector.

6. The switch of claim 1 in which said moveable contact comprises a thimble-like contact having a cylindrical portion and at one end thereof an annular flange for contacting the coined ends of said conductors.

7. The switch of claim 6 in which said biasing means includes a coil spring located within said cylindrical portion and biasing said contact against a cylindrical stud comprising a portion of said cover and aligned with said axis.

8. The switch of claim 6 in which said cover includes:

an annular recess aligned with said axis for receiving said annular flange, and a cylindrical stud located in said recess and aligned with said axis.

9. The switch of claim 8 in which said biasing means comprises a coil spring located between said guide stud at least partially within said cylindrical portion.

10. The switch assembly according to claim 1, wherein said actuator means comprises a strand of material passing through said aligned switch assembly, said strand including stop means attached to a first end portion adjacent said plunger for preventing said first end portion from being drawn through said aligned apertures.

11. The switch assembly according to claim 10, wherein said stop means comprises a tie knot formed in said first end portion, with said tie knot having a larger diameter than an aperture through said plunger in alignment with the apertures through said moveable contact and housing.

12. A switch assembly according to claim 10, wherein said strand is formed of a filament of fish line type material.

13. A pushbutton switch for electrically connecting a pair of conductors, each having coined ends retained in said switch, said switch comprising:

a housing including a barrel with an axis and a head portion generally transverse to said axis, a cover secured to said head with said coined conductor ends secured, in electrically non-contacting relation, between said head and cover, a moveable contact which is moveable along said axis for bridging said coined ends for electrically connecting said conductors, plunger means mounting said moveable contact for axial movement to break an electrical connection, said plunger means axially slidable in said barrel, aligned apertures axially extending through said plunger, said moveable contact and said housing, respectively, biasing means yieldably biasing said moveable contact and said plunger means to a retracted position in which position said moveable contact bridges said conductors, actuator means positioned within said axially aligned apertures for selectively stroking said plunger axially within said barrel, said moveable contact normally retained in bridging relation with said conductors under the influence of said biasing means and moveable to a projected position in response to said actuator means causing axial projection of said plunger means.

14. A pushbutton switch for electrically connecting a pair of stationary contacts retained in said switch, said switch comprising:

a housing including a barrel with an axis and head portion generally transverse to said axis, a cover secured to said head with said stationary contacts secured, in electrically non-contacting relation, between said head and cover, a moveable contact which is moveable along said axis for bridging said stationary contacts and electrically connecting conductors, connected to said stationary contacts, plunger means mounting said moveable contact for axial movement to break said electrical connection, said plunger means being axially slidable in said barrel, aligned apertures axially extending through said moveable contact, said plunger and said housing, respectively, biasing means yieldably biasing said moveable contact and plunger means to a retracted position in which position said contact bridges said conductors, strand actuator means extending through said biasing means and positioned within said axially aligned apertures in said moveable contact, plunger and housing for selectively stroking said moveable contact axially within said barrel.

15. A pushbutton switch for electrically connecting a pair of stationary contacts retained in said switch, said switch comprising:

a housing including a barrel with an axis and head portion generally transverse to said axis, a cover secured to said head with said stationary contacts secured, in electrically non-contacting relation, between said head and cover, a moveable contact which is moveable along said axis for bridging said stationary contacts and electrically connecting conductors, connected to said stationary contacts, plunger means mounting said moveable contact for axial movement to make said electrical connection, said plunger means being axially slidable in said barrel, aligned apertures axially extending through said moveable contact, said plunger and said housing, respectively, biasing means yieldably biasing said moveable contact and plunger means to a retracted position in which position said moveable contact is out of contact with said stationary contacts, and strand actuator means extending through said biasing means and positioned within said axially aligned apertures in said moveable contact, plunger and biasing for selectively stroking said moveable contact axially within said barrel.

* * * * *